US009079302B2

(12) United States Patent
LaLonde et al.

(10) Patent No.: US 9,079,302 B2
(45) Date of Patent: Jul. 14, 2015

(54) SYSTEM FOR SECURING SHIPMENT OF ROTARY CUTTING DIES

(71) Applicant: Midwest Steel Rule Cutting Die, Inc., Indianapolis, IN (US)

(72) Inventors: Michael L. LaLonde, Greenwood, IN (US); David Jeffries, Indianapolis, IN (US)

( * ) Notice: Subject to any disclaimer, the term of this patent is extended or adjusted under 35 U.S.C. 154(b) by 343 days.

(21) Appl. No.: 13/744,402

(22) Filed: Jan. 17, 2013

(65) Prior Publication Data

US 2013/0240392 A1 Sep. 19, 2013

Related U.S. Application Data

(60) Provisional application No. 61/587,305, filed on Jan. 17, 2012.

(51) Int. Cl.
*B65D 85/30* (2006.01)
*B25H 3/00* (2006.01)

(52) U.S. Cl.
CPC ..... *B25H 3/003* (2013.01)

(58) Field of Classification Search
USPC ..... 206/588, 590, 591, 592, 594, 446, 448
See application file for complete search history.

(56) References Cited

U.S. PATENT DOCUMENTS

| | | | | |
|---|---|---|---|---|
| 1,635,430 | A | 7/1927 | Murphy | |
| 3,235,065 | A * | 2/1966 | Deeren | 206/446 |
| 3,884,356 | A * | 5/1975 | Lidgard | 206/591 |
| 3,938,661 | A * | 2/1976 | Carmody | 206/523 |
| 4,678,084 | A | 7/1987 | Maker et al. | |
| 5,069,338 | A | 12/1991 | Grigsby | |
| 5,328,033 | A | 7/1994 | Ptaschinski | |
| 6,431,362 | B1 * | 8/2002 | Araki et al. | 206/588 |
| 2001/0027932 | A1 * | 10/2001 | Arima | 206/523 |
| 2002/0179486 | A1 * | 12/2002 | Hurwitz et al. | 206/588 |
| 2003/0132135 | A1 | 7/2003 | Natale et al. | |
| 2011/0253589 | A1 * | 10/2011 | Webb et al. | 206/590 |

FOREIGN PATENT DOCUMENTS

WO 2009105028 A1 8/2009

* cited by examiner

*Primary Examiner* — Jacob K Ackun
(74) *Attorney, Agent, or Firm* — Krieg DeVault LLP

(57) ABSTRACT

A system including two end inserts each having a first plurality of layers; an intermediate insert having a second plurality of layers; a packaging section; and a rotary die. The first plurality of layers includes at least one layer having a handling portion removed to form a handle member, a positioning portion removed to form a positioning member; and a first supporting portion removed to form a first supporting member. Each of the second plurality of layers can have a second supporting portion removed to form a second supporting member. The first end insert is placed on or proximate to a first end of the rotary die, the second end insert is place on or proximate to a second end of the rotary die, the intermediate insert is positioned on or proximate to an intermediate portion of the rotary die, and the packaging section is positioned approximate the first end, second end, and intermediate inserts and the rotary die.

18 Claims, 5 Drawing Sheets

SYSTEM FOR SECURING SHIPMENT OF ROTARY CUTTING DIES

TECHNICAL FIELD

The present invention generally relates to shipping devices, and more particularly, but not exclusively, to shipping insert systems for rotary cutting dies.

BACKGROUND

Present approaches to shipping rotary cutting dies and other devices suffer from a variety of drawbacks, limitations, disadvantages and problems including without limitation damage to the rotary cutting dies and other devices during shipping and others. There is a need for the unique and inventive shipping device apparatuses, systems and methods disclosed herein.

SUMMARY

One embodiment of the present invention includes a unique shipping system. Other embodiments include apparatuses, systems, devices, hardware, methods, and combinations for a system to reduce damage to rotary cutting dies during shipping. Further embodiments, forms, features, aspects, benefits, and advantages of the present application shall become apparent from the description and figures provided herewith.

Die cutting is the process of using a die to shear layers of low strength materials, such as rubber, fiber, foil, cloth, paper, corrugated fiberboard (cardboard), paperboard, plastics, pressure sensitive adhesive tapes, foam, sheet metal and the like. Rotary die cutting includes a cylindrical die on a rotary press. A long sheet of material is fed through a press to an area which holds a cylindrical rotary dieboard that can cut out shapes, make perforations or creases, or cut the sheet into smaller parts.

Manufacturers ship rotary dieboards for rotary die cutting as partial shells. Usually, these shells are shipped as a half-cylinder or partial-cylinder. The shells are susceptible to shipping damage due to handling impact forces being transferred to the convex surface or the longitudinal ends of the shell or by circumferential forces. Impact can come from the weight of the shell itself or from the forces of other objects applied to a portion of the shell and transferred to the edges. The half-shells may contact each other during shipment resulting in damage to the first half-shell that may be bearing some or all of the weight of the second half-shell.

DETAILED DESCRIPTION OF THE ILLUSTRATIVE EMBODIMENTS

Figure 1:
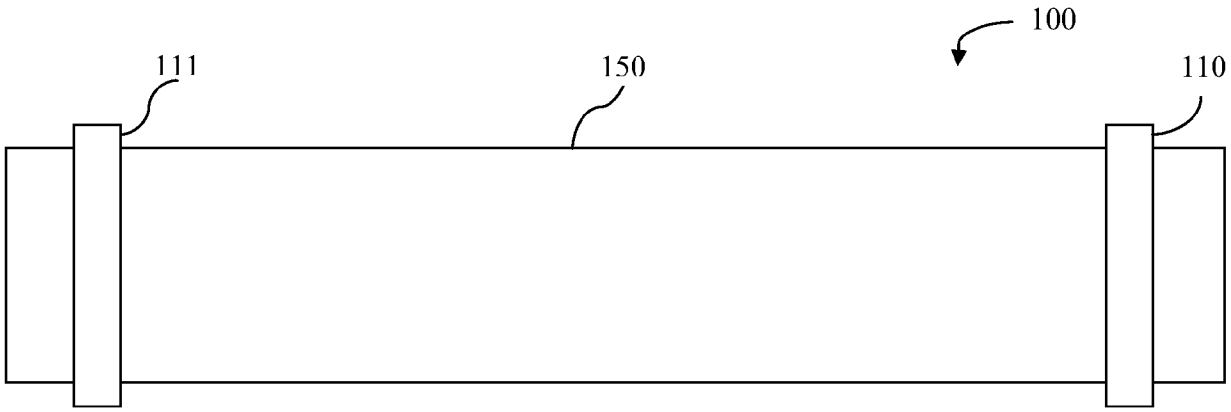
FIG. 1 is an illustration of one embodiment of the present application.

For the purposes of promoting an understanding of the principles of the invention, the embodiments illustrated in the drawings and specific language are used to describe the same. The applicant does not limit the scope of the invention to the disclosed embodiments. Any alterations and further modifications in the described embodiments, and any further applications of the principles of the invention as described herein are contemplated as would normally occur to one skilled in the art to which the invention relates.

With reference to FIG. 1, an illustration is shown of one embodiment of a packaging insert system 100 including a set of two end inserts 110,111 configured with at least a partial portion of a rotary die board 150. The end inserts can be formed as caps at the edge of the rotary die portion. In the alternative, the end inserts can be formed to allow the rotary die board to be positioned through the end inserts. End inserts can be positioned in various locations along and around a rotary die portion and each end insert can be positioned independently of another end insert.

Figure 2:
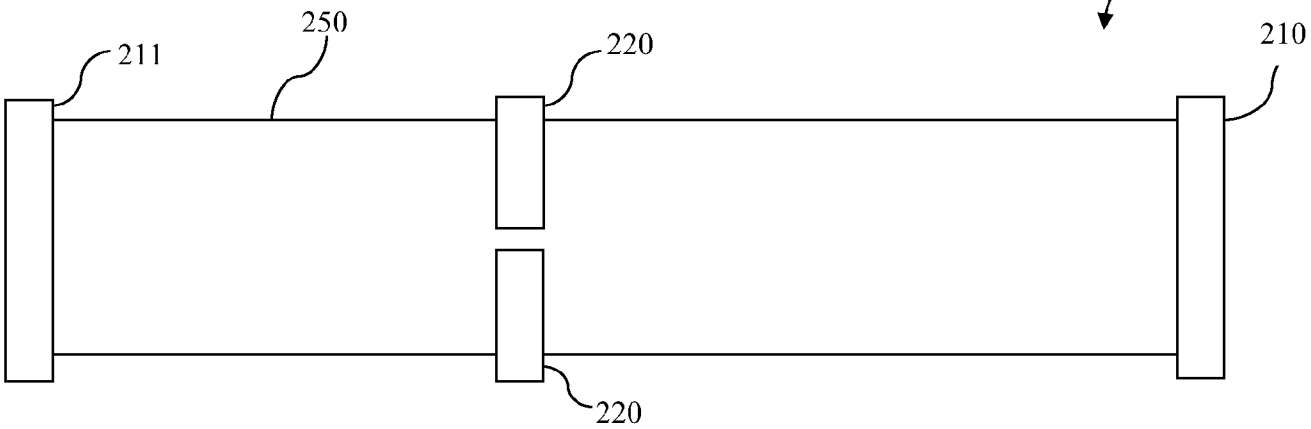
FIG. 2 is another illustration of one embodiment of the present application

In another embodiment shown in FIG. 2, a packaging insert system 200 can include a set of two end inserts 210,211 and an intermediate insert 220 positioned along a component 250 between the set of two end inserts 210,211. Intermediate inserts can be configured to allow positioning of the insert in various locations and in various orientations in relation to a component. An intermediate insert can be configured to be placed in a position above or below a component or to be placed both above and below a component. An intermediate insert can be configured to surround the component on each side. More than one intermediate insert can be applied to a component.

Embodiments of the present application can include various combinations of end inserts and intermediate inserts. In one embodiment, the combination and configuration of end and intermediate inserts can depend on characteristics of the rotary die portion including but not limited to geometry, size, weight, blade profile, and the like.

In specific embodiments, a shipping insert system can be applied to a single shell of a rotary dieboard, a half shell and a partial shell of a rotary dieboard, two half shells of a rotary dieboard, and others.

In one embodiment, the material and packaging insert system can be constructed for a single use or as a disposable system. In another embodiment, the material and insert system can be constructed for multi-use or as a reusable or returnable dunnage system.

Some embodiments can include packaging systems designed or modified to accommodate component characteristics of a specific rotary die portion. Packaging systems in other embodiments of the present application can have a universal configuration for various components. Characteristics which can affect the configuration of a packaging system can include but are not limited to diameter, radius, thickness, arch, length, blade height, blade location, blade distribution, weight, and the like.

Inserts of a packaging insert system for one embodiment can include layers of material which can be conventional packaging materials such as corrugated paperboard, plastic, composites, and the like. Inserts can include a laminate structure with a plurality of layers formed together. Each layer can have an individual configuration or multiple layers can have similar configurations. Layers can be formed of similar or varying materials. Factors affecting a laminate structure of an insert of an embodiment of the present application can include, but are not limited to, die geometry, die weight, and laminate layer properties, for example.

The layers of an insert can include at least one layer having portions removed to create features in the insert. One feature can include removing a handling portion to create a handle member. Another feature can include removing an aligning portion to create an aligning member. Yet another feature can include removing a supporting portion to create a supporting member. Further the outline of an insert can be configured to facilitate or fit a protective packaging system, a transportation placement mechanism, and the like.

Figure 3:
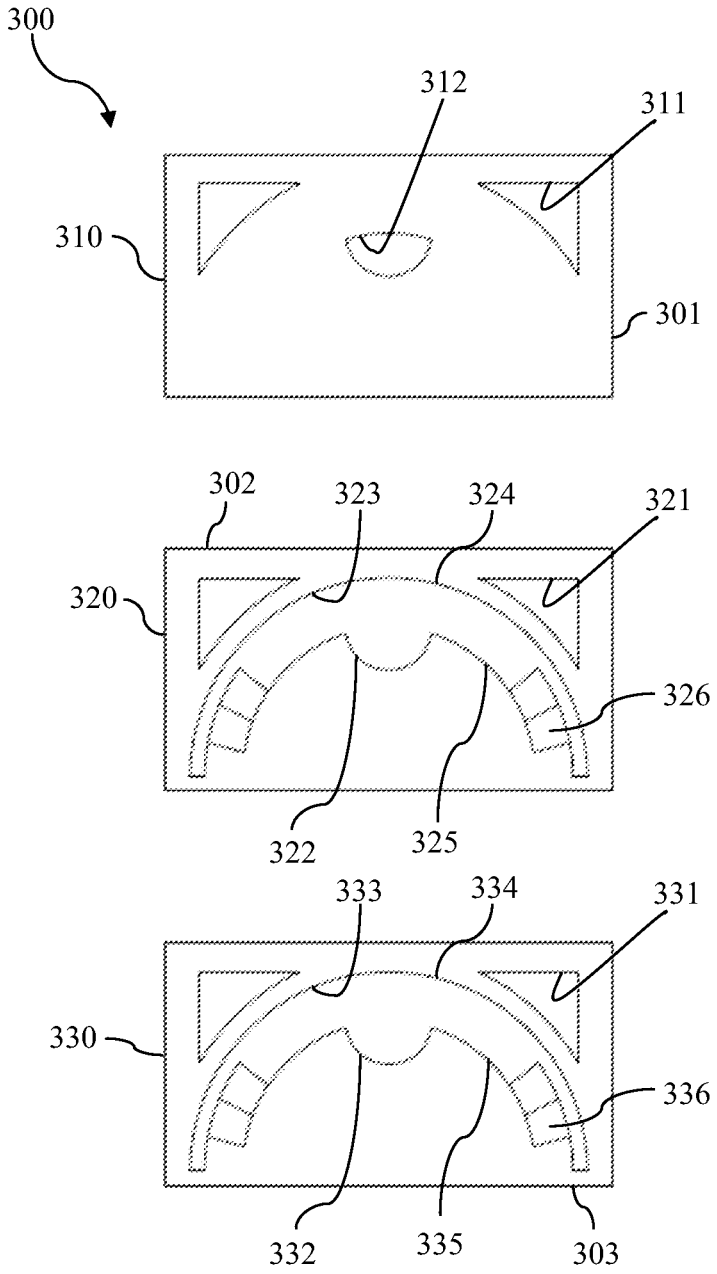
FIG. 3 is an expanded view of a schematic diagram one embodiment of a packaging insert system having an adjustable end insert.

A non-limiting example of a shipping insert system of one embodiment includes two end inserts 300 shown singly in FIG. 3. An individual end insert 300 can be of a single design or varying design. End insert 300 is shown in an expanded view with layers separated and includes at least a first layer 310, a second layer 320 and a third layer 330. First layer 310, second layer 320 and third layer 330 are integrated to form end insert 300. In other embodiments inserts can include more or less layers than that shown in FIG. 3.

First layer 310 is shown to include a first portion which is removed to provide a corner member 311, a handling portion removed to provide a handle member 312, and a first outline 301 to facilitate packaging and placement during shipping and storage. Second layer 320 is shown to include a first portion removed to provide a corner member 321, a handling portion removed to provide a handle member 322, a positioning portion removed to provide a positioning member 323 and a second outline 302 matching first outline 301.

Positioning member 323 is shown in FIG. 3 to be configured for a component of an arced end profile. Positioning member 323 can be formed by two concentric arcs 324,325 separated by a distance approximate a thickness of a component end wall. The spacing of the arcs and the length of the arcs can be determined to provide limited movement of a component fitted with the insert. Third layer 330 is shown to be configured similarly to second layer 320 and having a corner member 331, a handle member 332, a positioning member 333 formed by two concentric arcs 324,325 and a third rectangular outline 303. Details of each layer can vary to provide a varying end insert design when the layers are assembled.

The embodiment of end insert 300 as shown in FIG. 3 has a feature to accommodate components of variable arc length. Second layer 320 of end insert 300 has an adjustable section 326 to allow positioning of a first arc length component. Adjustable section 326 provides a positioning member which can limit movement of a component in relation to the insert and other packaging pieces based on the dimensions of that particular component. Adjustable portions of adjustable section 326 can be configured to approximate the arc lengths of components in embodiments which include rotary die half-shells for packaging. Adjustable section 326 can be adjusted by a deflection or compression, for example, of a portion of adjustable section 326. In another embodiment, portions of adjustable section 326 can be removed. Removal of portions of adjustable section 326 can include displacing portions with or without a complete or permanent separation.

The embodiment of end insert 300 also has an adjustable section 326 to allow positioning of a first arc length component and a second arc length component where the first arc length is greater than the second arc length. A first component (not shown) with a shorter arc length can be supported by inner concentric arc 325. The arc length of the component is accommodated by the removal of portions of adjustable section 326. The first component can be positioned within the packaging system singly or can be positioned with a second component. The second component (not shown) with a longer arc length can be placed above the shorter arc length component supported by portions of adjustable section 326 and concentric arc 324. Additionally, either the first or second component can be positioned within the packaging system singly.

First layer 310, second layer 320 and third layer 330 are shown in FIG. 3 with a handle member 312,322,332 respectively. When end insert 300 is formed by placing layers 310, 320,330 together, handle members 312,322,332 are aligned in this embodiment to provide a feature suitable for handling end insert 300. Handling members 312,322,332 can include handling end insert 300 alone, when positioning the end insert, or once the end insert has been positioned with a component. The corner members 311,321,331 can serve various purposes including alignment and handling.

Figure 4:
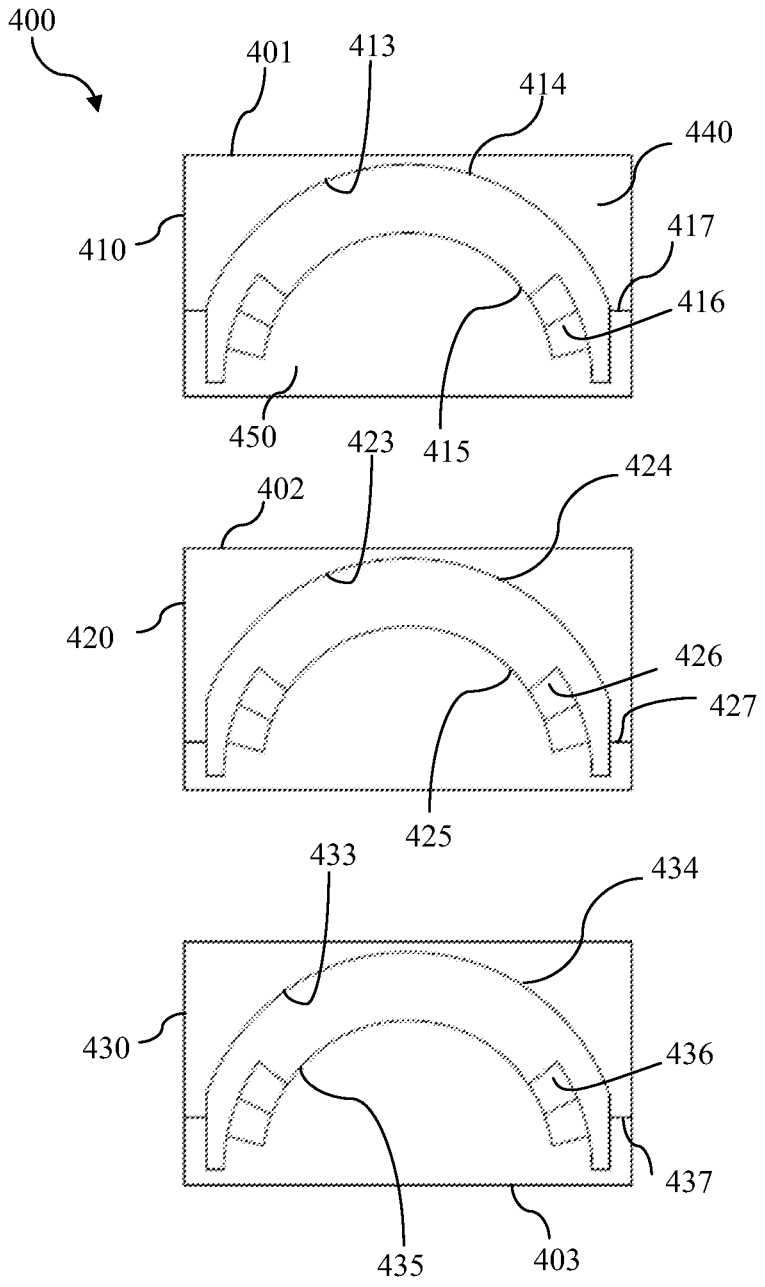
FIG. 4 is an expanded view of a schematic diagram one embodiment of a packaging insert system having an adjustable intermediate insert.

In an embodiment with a component having an extended cylinder length, one or more intermediate inserts can be placed along the length of the partial cylinder to provide support and stability to the packaging system. More intermediate inserts can be applied to longer components or to components with less structure. FIG. 4 is an expanded schematic view of an intermediate insert 400 to be placed along the length of a component in between the end inserts as part of the shipping insert system. Intermediate insert 400 is formed by a first layer 410, a second layer 420 and a third layer 430.

An intermediate insert can have a multiple piece configuration which allows the insert to be positioned along the length of the component between end inserts. Intermediate insert 400 as shown in the embodiment in FIG. 4 includes two segments 440,450 aiding in the placement of the insert around a component. Intermediate insert can include multiple segments of varying size and distributions. In some embodiments, segments of the intermediate insert are independent or do not form a continuous configuration.

In embodiments where the intermediate insert is made of two or more segments placed at various locations along the component, one segment can be positioned below the component. Additionally, a segment can be positioned above a component. The segmented configuration facilitates the placement of the intermediate insert along the dieboard. In one particular embodiment, the component is a rotary dieboard including cutting and folding features at various points along the surface of the dieboard. An intermediate insert can be located so as to not disturb the features of the dieboard and to reduce a likelihood of damage to the rotary cutting die's cutting and folding features.

First layer 410 is shown having a positioning portion which is removed to provide a positioning member 413 and a first rectangular outline 401. Positioning member 413 is shown in this embodiment as being configured for a component with an arced end profile. Positioning member 413 is formed by two arcs 414,415. Two arcs of the positioning member can be separated by a distance approximate or similar to the thickness of the component end wall. Other configurations are contemplated to accommodate other component profiles.

Second layer 420 and third layer 430 are shown to be configured similar to first layer 410. Second layer 420 and third layer 430 have a positioning member 423,433, respectively. Positioning members 423,433 are shown as being formed by two arcs 424,425 and 434,435, respectively. Second layer 420 has a second outline 402 and third layer 430 has a third outline 403. Second outline 402 and third outline 403 are shown to match first outline 401 which together form an outline for insert 400. For one embodiment, the outline for insert 400 is capable of facilitating packaging and placement during shipping and storage.

In another embodiment, an intermediate supporting portion removed from the intermediate insert can provide an intermediate supporting member. Supporting members formed by curved portions can be capable of fitting an arced first component against a first intermediate arced surface and a second arced component against a second intermediate arced surface. Intermediate insert 400 as shown in the embodiment of FIG. 4 can be capable of accommodating components of variable arc length as discussed previously for the end insert. Layers 410,420,430 of intermediate insert 400 have an adjustable section 416,426,436 to allow positioning of a first arc length component and a second arc length component where the first arc length can be different than the second arc length. For layers 410,420,430 a first component (not shown) with a first arc length can be placed against inner arcs 415,425,435. The arc length of the component is accommodated by removal of portions of adjustable sections 416, 426,436. A second component (not shown) with a second arc length can be placed above the first arc length component and against outer arcs 414,424,434 and remaining portions of adjustable sections 416,426,436.

As intermediate insert 400 includes two segments for this embodiment, each of first layer 410, second layer 420 and third layer 430 is shown with a knit line 417,427,428, respectively, where the multiple segments (shown as two in FIG. 4) come together. The location of knit line 417 can be located at a position on first layer 410 different than from the other layers 420,430. In various embodiments, each layer can have a knit line located uniquely compared to the other layers creating a staggered configuration. When layers are then assembled, the mating edges of the intermediate insert can have variable depths creating an interlocking form. An interlocking form is capable of limiting displacement or separation of the segments. In one embodiment, the interlocking mechanism can provide stability to intermediate insert 400 following placement approximate the component. Features or mechanisms can be applied to the layers which provide for association or positioning of the multiple segments together.

Figure 5:
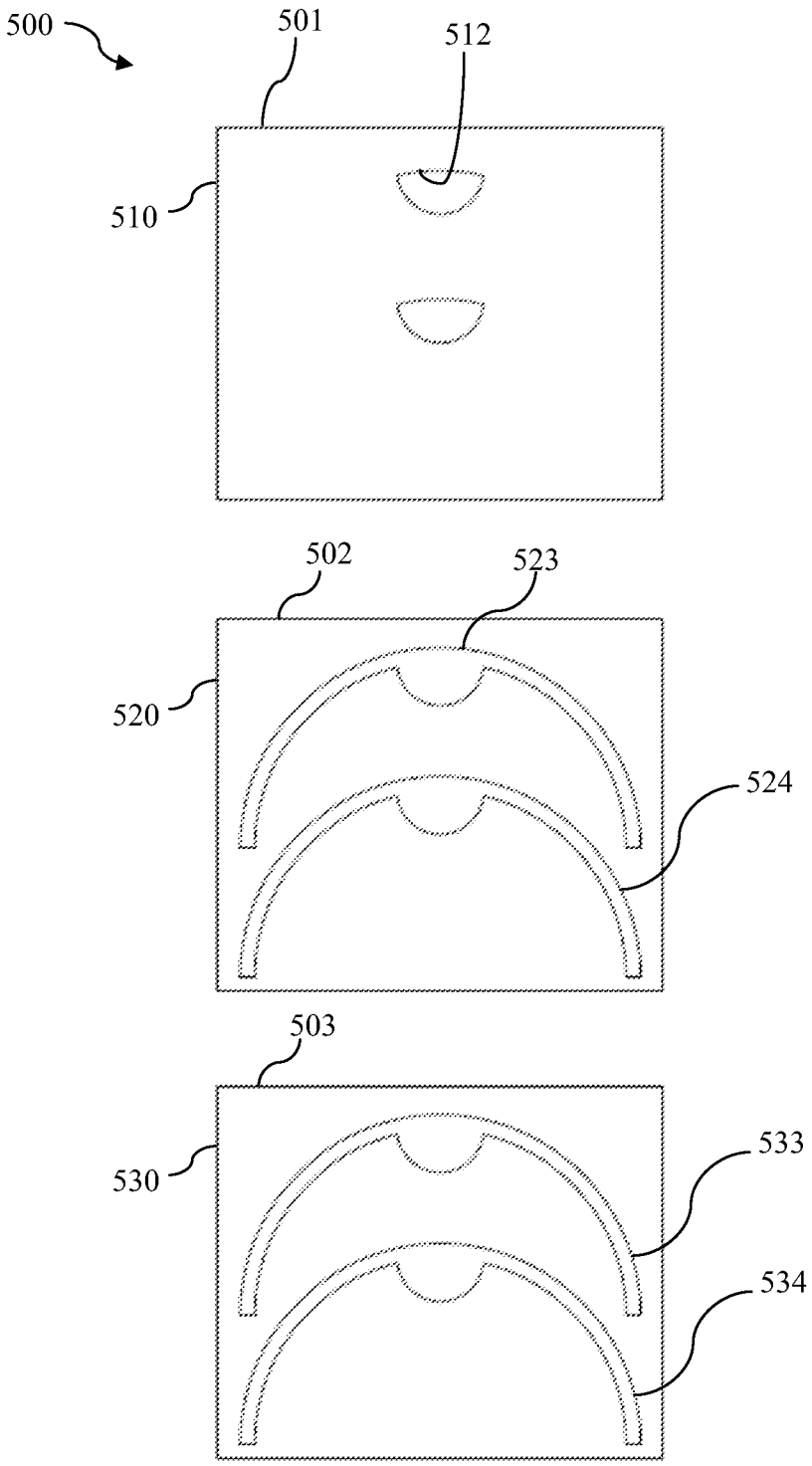
FIG. 5 is an expanded view of a schematic diagram of another embodiment of a packaging insert system having a multi-component end insert.

FIG. 5 is an expanded view of a schematic drawing of another embodiment of an end insert 500. End insert 500 is shown with three layers 510,520,530. First layer 510 has at least one handle member 512. Second layer 520 and third layer 530 can have one or more supporting members and are shown with two each 523,524, and 533,534. Supporting members 523,524,533,534 are each shown as being formed by two arcs separated by a distance approximate a thickness of a component end wall. While shown to be a uniform thickness, supporting members can vary with the geometry of a component. Two supporting members can vary between each other to accommodate various components.

The end inserts of the embodiment shown in FIG. 5 with two supporting members are capable of being part of a packaging system containing two components. In other embodiments, more or less positioning members can be present. In this non-limiting configuration, the two components are supported in a position which separates one from another. Separation of components can allow a minimization of the direct transfer of forces from one component to another. Components can be supported by arced surfaces of a supporting member for retention and load transfer, for example. Further, layers 510,520,530 have rectangular outlines 501,502,503, respectively, to facilitate packaging and placement during shipping and storage.

Figure 6:
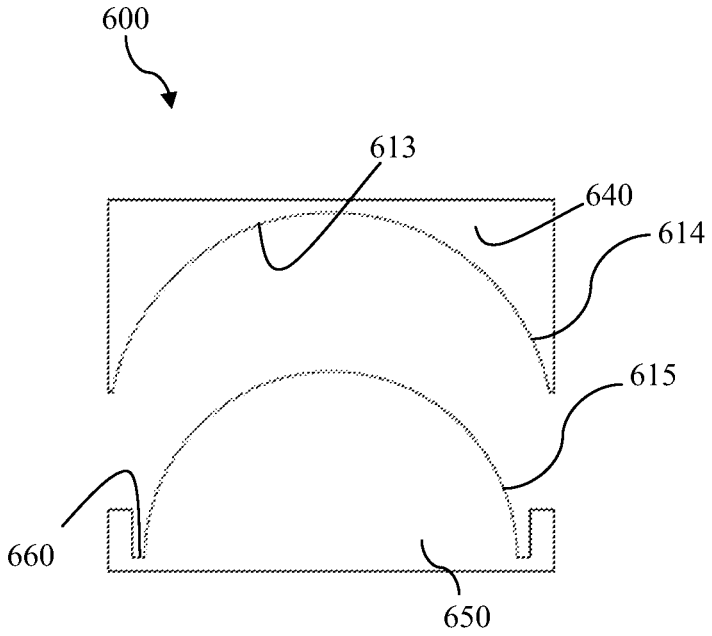
FIG. 6 is a schematic diagram of another embodiment of a packaging insert system having a multi-component intermediate insert.

Another embodiment of an intermediate insert 600 is shown in FIG. 6 having two segments 640,650 and a positioning member 613 formed by the removal of a positioning portion having concentric arcs 614,615. As shown in this embodiment, segment 640 can be positioned on a convex surface of a component (not shown) supported by concentric arc 614. Segment 650 can be positioned on a concave surface of the same component or another component positioned below the first component supported by concentric arc 615. Another feature shown in FIG. 6 is capable of positioning the longitudinal ends of the component adjacent to segment 650 within a set of channels 660 positioned on outer portions of intermediate insert 600. Placement within channels 660 can facilitate limiting movement of the component relative to the insert.

For end inserts and intermediate inserts of various embodiments, multiple positioning portions can be removed to provide multiple positioning members. Multiple positioning members can allow an insert system to accommodate a component with a non-uniform profile and a plurality of components, for example.

In one particular embodiment, two end inserts and one intermediate insert are part of a packaging system. Each insert includes three layers with rectangular outline dimensions of approximately 12 inches high by 24 inches wide. The three layers are adhered together to create a three layer corrugated build up for each insert. Other embodiments can have one or more layers.

Each layer of the end inserts has two corner members in the respective upper right and left corners which are approximately 1.25 inches from the upper and outer walls. The two inner layers of the end insert have an arcuate positioning shape with an outer radius of approximately 11 inches and an inner radius of approximately 9 inches. An end portion of the outer radius is approximately 1.25 inches from an outside wall in the bottom left and right corners and the outer radius and inner radius are spaced by approximately 0.5 inches.

The three layers of the intermediate insert have approximately similar configurations. The three layers have an arcuate positioning shape with an outer radius of approximately 9 inches and an inner radius of approximately 8 inches. The knit lines of the three layers are in a staggered configuration.

In another particular embodiment, two end inserts and one intermediate insert are part of a double packaging system. Each insert includes three layers with outline dimensions of approximately 20 inches high by 23 inches wide. The three layers are adhered together to create a three layer corrugated build up for the inserts.

The two inner layers of the end insert have two arcuate positioning shapes positioned one above the other. Each arcuate positioning shape has an outer radius and an inner radius. An end portion of the lower outer radius is approximately greater than 1 inch from the outside wall in the bottom left and right corners and the outer radii and inner radii of the arcuate positioning shapes are spaced by approximately 0.5 inches.

The three layers of the intermediate insert have the same or similar configuration as the aforementioned end insert. The three layers have an arcuate positioning shape with an upper outer radius of approximately 12 inches and a lower inner radius of approximately 10 inches. The lower inner radius is positioned adjacent to features of the intermediate insert which can position the longitudinal ends of the component. The features include a lip like configuration where the lip extends approximately 3.75 inches up the outer outline walls from the bottom corner of the insert. The space between the inner radius and the lip feature is approximately 0.75 inches.

One aspect of the present application is an apparatus having a first end insert and a second end insert with each having a first plurality of layers; and an intermediate insert having a second plurality of layers. Features of this aspect include the first plurality of layers having at least one layer with a handling portion removed to form a handle member and at least one inner layer having at least one positioning portion removed to form at least one positioning member. Each of the second plurality of layers can have a supporting portion removed to form a supporting member.

Further features of this aspect include the at least one positioning member having a generally arcuate shape with a first arc dimension different than a second arc dimension to provide the generally arcuate shape. Additionally, at least one positioning member can have at least one removable portion where the at least one positioning member is capable of adjustment.

Another aspect of the present application is a system including a first end insert and a second end insert each having a first plurality of layers; an intermediate insert having a second plurality of layers; an outer packaging section; and a rotary die. Features of this aspect include the first plurality of layers having at least one layer with a handling portion removed to form a handle member and at least one positioning portion removed to form a positioning member; the first plurality of layers having at least one layer with a first supporting portion removed to form a first supporting member; and each of the second plurality of layers having a second supporting portion removed to form a second supporting member. Further features include the first end insert being placed on or proximate to a first end of the rotary die, the second end insert being placed on or proximate to a second end of the rotary die, the intermediate insert being positioned on or proximate to an intermediate portion of the rotary die, and the outer package section positioned approximate the first insert, the second insert and the rotary die.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a first end insert; and a second end insert wherein the first end insert and the second end insert have a first plurality of layers, the first plurality of layers including at least one outer layer having a handling portion removed to form a handling member, and at least one inner layer having a positioning portion removed to form at least one positioning member.

2. The apparatus of claim 1, wherein the at least one positioning member is capable of adjustment with at least one adjustable portion.

3. The apparatus of claim 2, wherein the at least one positioning member further includes a first generally arcuate shape.

4. The apparatus of claim 1, further including an intermediate insert having a second plurality of layers, the second plurality of layers including a supporting portion removed to form a supporting member.

5. The apparatus of claim 4, wherein the supporting member is capable of adjustment with at least one adjustable portion.

6. The apparatus of claim 5, wherein the supporting member further includes a second generally arcuate shape.

7. The apparatus of claim 1, wherein the second end insert further includes a third plurality of layers.

8. A system comprising:

a first end insert and a second end insert each having a first plurality of layers, the first plurality of layers including at least one outer layer having a handling portion removed to form a handling member, and at least one inner layer having a first supporting portion removed to form a first supporting member;

an intermediate insert having a second plurality of layers, each of the second plurality of layers having a second supporting portion removed to form a second supporting member; and a rotary die, wherein the first end insert is placed proximate a first end of the rotary die, the second end insert is place proximate a second end of the rotary die, and the intermediate insert is positioned on an intermediate portion of the rotary die between the first end insert and the second end insert.

9. The system of claim 8, wherein the first supporting member is capable of adjustment with at least one removable portion.

10. The system of claim 9, wherein the second supporting member is capable of adjustment with at least one removable portion.

11. The system of claim 8, wherein the first plurality of layers further includes at least one aligning portion removed to form an aligning member.

12. The system of claim 8, further including the first end insert placed on a first end of the rotary die and the second end insert placed on a second end of the rotary die.

13. The system of claim 8, wherein the first supporting member further includes a first generally arcuate shape and wherein the second supporting member further includes a second generally arcuate shape.

14. The system of claim 13, wherein the first generally arcuate shape is formed by a first arc dimension different from a second arc dimension.

15. The system of claim 8, further including an outer packaging section.

16. A system comprising:

a first end insert and a second end insert each having a first plurality of layers, the first plurality of layers including at least one outer layer having a handling portion removed to form a handling member and an aligning portion removed to form an aligning member; and at least one inner layer having a first positioning portion removed to form a first positioning member and a second positioning portion removed to form a second positioning member;

an intermediate insert having a second plurality of layers, each of the second plurality of layers having a supporting portion removed to form a supporting member; and a rotary die, wherein the first end insert is placed proximate a first end of the rotary die, the second end insert is place proximate a second end of the rotary die, and the intermediate insert is positioned on an intermediate portion of the rotary die between the first end insert and the second end insert.

17. The system of claim 16, wherein the supporting member is capable of adjustment with at least one adjustable portion.

18. The system of claim 17, wherein the first positioning member and the second positioning member further include a generally arcuate shape.

* * * * *